US006394014B1

(12) United States Patent
Waldock

(10) Patent No.: US 6,394,014 B1
(45) Date of Patent: May 28, 2002

(54) MARINE VESSEL AND METHOD OF MANUFACTURING

(76) Inventor: William L. Waldock, 117 E. Washington Row, Sandusky, OH (US) 44870

( * ) Notice: Subject to any disclaimer, the term of this patent is extended or adjusted under 35 U.S.C. 154(b) by 0 days.

(21) Appl. No.: 09/659,984

(22) Filed: Sep. 12, 2000

(51) Int. Cl.[7] ..... B63B 1/00
(52) U.S. Cl. ..... 114/61.1; 114/356
(58) Field of Search ..... 114/65 R, 355, 114/356, 359

(56) References Cited

U.S. PATENT DOCUMENTS

| | | | | |
|---|---|---|---|---|
| 2,099,438 A | * | 11/1937 | Gilbert | 114/356 |
| 2,312,722 A | * | 3/1943 | Lermont | 114/356 |
| 3,060,464 A | | 10/1962 | Robison | |
| 3,168,425 A | | 2/1965 | Wiplinger | |
| 3,179,961 A | | 4/1965 | Ward et al. | |
| 3,190,408 A | | 6/1965 | Petterson | |
| 3,190,409 A | | 6/1965 | Petterson | |
| 3,298,343 A | | 1/1967 | Juhnke | |
| 3,388,446 A | | 6/1968 | Phillips | |
| 3,429,088 A | | 2/1969 | Katzman | |
| 3,811,141 A | | 5/1974 | Stoeberl | |
| 3,884,171 A | * | 5/1975 | Kline | 114/356 |
| 3,960,102 A | | 6/1976 | Davy | |
| 4,046,091 A | | 9/1977 | Lomas, III et al. | |
| 4,457,249 A | | 7/1984 | Disen | |
| 4,458,623 A | | 7/1984 | Lovquist | |
| 4,508,047 A | | 4/1985 | Bordat | |
| 4,552,085 A | | 11/1985 | Eder et al. | |
| 4,565,146 A | | 1/1986 | Koser et al. | |
| 4,572,096 A | | 2/1986 | Payne | |
| 4,599,963 A | | 7/1986 | Payne | |
| 4,662,299 A | | 5/1987 | Eder et al. | |
| 4,803,944 A | | 2/1989 | Roberson | |
| 5,199,368 A | | 4/1993 | Souda | |
| 5,242,523 A | | 9/1993 | Willden et al. | |
| 5,743,203 A | | 4/1998 | NcNamara | |
| 5,830,308 A | | 11/1998 | Reichard | |

FOREIGN PATENT DOCUMENTS

| | | |
|---|---|---|
| FR | 1454698 | 10/1966 |
| GB | 4695 | of 1889 |
| NL | 6716643 | 6/1968 |

* cited by examiner

*Primary Examiner*—Jesus D. Sotelo
(74) *Attorney, Agent, or Firm*—Scott M. Oldham of Hahn Loeser & Parks LLP

(57) ABSTRACT

The invention is directed to a marine vessel and method of construction, wherein the vessel hull is formed to have a bottom and side portions, and includes a frame comprising a plurality of at least frame and/or stringer members extending crosswise or lengthwise and selectively fixed to the bottom or side portions of the hull. The frame and/or rib members are fixed to the hull to provide structural integrity. The frame and/or rib members are fixed into engagement by an adhesive bond; wherein the adhesive bond provides an amount of resiliency to dampen vibrations and other forces at the location of engagement. The invention is also directed to a method of forming the hull using a plurality of sheet members, each of which is formed with a plurality of complex or differential bends. The sheets are formed by imparting consecutive and sequential bends in the various sheets to form at least a part of the side and bottom portions of the hull, while concomitantly imparting a desired curvature from fore to aft. It is also an aspect of the invention that the hull design and associated structures are repeatably manufactured in a production boat rather than custom, and the designs are scalable to meet user requirements. A computer program to allow designing and modification of a vessel is also provided.

42 Claims, 6 Drawing Sheets

MARINE VESSEL AND METHOD OF MANUFACTURING

TECHNICAL FIELD

This invention relates generally to marine vessels and, more specifically, to sheet or panel clad marine vessel hull construction wherein sheet skin layers are formed with differential bends and are adhesively bonded to frame members to avoid welding procedures and formation of heat affected areas. This invention also includes a unique method of constructing such a marine vessel hull.

BACKGROUND OF THE INVENTION

The materials of construction for a boat hull require the combination of formability, strength, attractive appearance, low maintenance and durability in the marine environment. The boat hull has been developing for thousands of years. For a very substantial period of time boat hulls of varying sizes have been constructed of wood. Wooden hulls typically use a wooden skeleton of transverse ribs on which the planks are mounted and secured. They are made watertight by caulking with oakum, the pressure necessary for a watertight joint being produced by soaking the wood to swell it. However, wooden boat hulls disadvantageously require substantial maintenance and are subject to deterioration. In addition wooden hulls require substantial labor costs for construction and use of increasingly costly wood materials.

The next stage of development was ship hulls of steel wherein the planking, formed of three-dimensional shaped steel plates, was secured by riveting to a steel skeleton. Caulking and closely juxtaposed rivets make the joints watertight. Later, with the development of welding technology, the planks were welded in place as employed still today in modem-day construction of large boat hulls.

More recently, boat hulls have been increasingly constructed of fiberglass. Fiberglass is utilized to allow manufacturing of the hull into complex curvatures and shapes. The shape the boat hull is quite difficult to fabricate from materials such as steel or the like. Complex shapes are possible by using molds, but such molds are themselves difficult to fabricate and are very expensive, particularly for more complex shapes, such as catamaran style hulls. Fiberglass also provides a desired outer appearance in the boat, being smooth and aesthetically pleasing, and also being easily painted or otherwise decorated. At the same time, fiberglass hulls do have some disadvantages. First, fiberglass has the tendency to fracture. Moreover, fiberglass does not have as much rigidity as other materials, such as steel or an aluminum hull boat would have. Manufacturing with fiberglass materials can also be environmentally problematic. The manufacture of fiberglass can result in the release of volatile organic compounds that are distressing in both the manufacturing facilities and the immediate environment. The volatile organic compounds used in fiberglass manufacture are hazardous materials and can also be destructive to ozone in the atmosphere. In addition, fiberglass blisters, absorbs water, and requires special finishes and maintenance to protect it from the sun or other environmental conditions.

There have also been attempts at constructing larger boats with hulls made of aluminum. Unlike the fiberglass hulls, aluminum is less subject to fracturing and yet is lightweight. Although having these desirable characteristics, disadvantages of using aluminum are found in the time consuming assembly steps to achieve any complex curvatures or shapes and to obtain smoothness for cosmetics. Aluminum hulls are usually constructed by a process of forming metal sheets, for example two sheets side by side for the underwater panels, two side panel sheets joined at their front ends to a stem and along their lower edges to the underwater panels, and a sheet for the transom. The use of formed sheets generally limits the shapes achievable, particularly for large boats of eighteen feet or longer. The shapes are further limited by the requirement to form each sheet separately and precisely to match with the adjacent sheets. The sheets are then welded along the seams where they join one another, frequently along with extrusions of metal on the seams. The welding operation is one of the most expensive operations in the construction of a boat hull using aluminum. Additionally, a frame structure is then welded into place to provide structural integrity, and support for decking or other surfaces. The most commonly used metal in such construction is marine grade aluminum, which upon welding, suffers damage and/or weakening in a heat-affected zone near the weld site. This heat-affected zone is subject to cracking under fatigue loading. There are also additional problems associated with the welding. The welds can fail and are subject to oxidation. Also, the welds are typically overdesigned such that too much welding is done, unnecessarily adding to the cost and further weakening the surrounding metal. It is also necessary to have very close tolerances between the members to be welded, generally resulting in significant scrap material, and increasing costs. The heat-affected zone is also visibly altered, creating a blemish on the exterior of the hull. It is a significant drawback of aluminum boats that welding produces blemishes, such as surface disfiguration, which destroys the desired smooth appearance. Such blemishes must be cosmetically repaired, typically using a bondo type product, to yield an outer appearance as desired.

It would be of great benefit if the hull designed of aluminum could be formed from sheets, but yet allow performance enhancing compound, complex curves and shapes to be obtained, particularly for large boats of eighteen feet or longer. Similarly, it would be desirable to provide an aluminum boat with an aesthetically pleasing appearance without damage occurring from welding procedures. Additionally, it would be desirable to eliminate a significant amount of welding in forming structures of the boat, such as in attaching the support frame structure to the hull.

SUMMARY OF THE INVENTION

It is therefore an object of this invention to minimize reliance on welding by using an adhesive compound to connect frame members, decking and other structures to the hull.

It is a further object of this invention to provide a large panel built boat hull having a length of eighteen feet or greater with complex shapes and curves formed integrally therein. The boat hull may also be a catamaran style hull.

It is another object of this invention to provide a method of making a panel hull in an efficient and cost effective manner, and forming a hull having complex or differential curvatures and bends by selective and sequential bending of predesigned sheets of material. The bending procedures may be carried out repeatably by use of computer controlled brake presses, and over large lengths, to form a cost effective hull construction.

The invention is directed to a marine vessel and method of construction, wherein the vessel hull is formed to have a bottom and side portions, and includes a frame comprising a plurality of at least rib members extending crosswise and selectively fixed to the bottom or side portions of the hull. For some hull designs, particularly for larger hulls, it may also be desirable to provide stringer members, which extend longitudinally within the hull and are fixed into engagement with at least one of the bottom or side portions of the hull. The rib members extend across at least a portion of the width of the hull and are fixed to the hull to provide structural integrity. The rib members are fixed into engagement by an adhesive bond; wherein the adhesive bond provides an amount of resiliency to dampen vibrations and other forces at the location of engagement. The invention is also directed to a method of forming the hull using a plurality of sheet members, each of which is formed with a plurality of complex bends and has a compound curvature from the front to rear. The sheets are formed by imparting consecutive and sequential bends in the various sheets to form at least a part of the side and bottom portions of the hull, while concomitantly imparting a desired curvature from fore to aft. It is also an aspect of the invention that the hull design and associated structures are repeatably manufactured in a production boat rather than custom, and the designs are scalable to meet user requirements.

DETAILED DESCRIPTION OF THE PREFERRED EMBODIMENT

Figure 1:
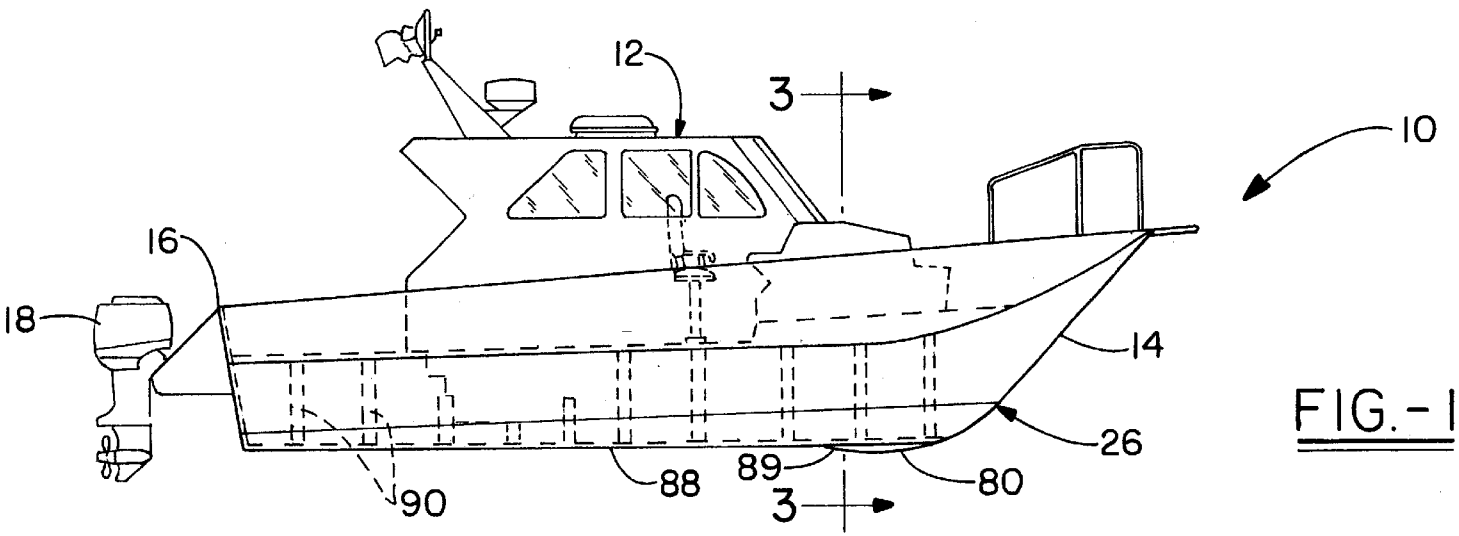
FIG. 1 is a partially see-through, side elevational view of a boat constructed in accordance with the present invention.
Figure 2:
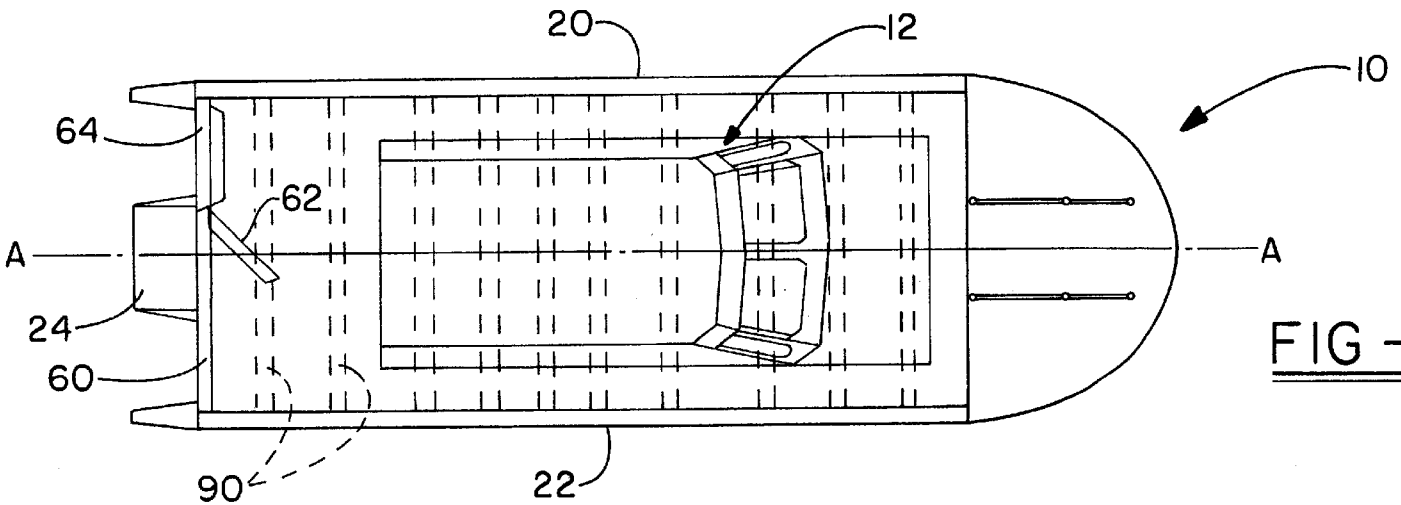
FIG. 2 is a top plan view of the boat of FIG. 1.

In a preferred embodiment of the invention, a boat 10 in the size range having a length of approximately 18' or greater is shown in various views in FIGS. 1–4. In boats of this size, the use of sheets in constructing a hull has been minimized due to the constraints mentioned previously. Although small "jon" boats have sometimes been produced of single sheets of metal, such as aluminum, once the size of the boat increases, several sheets of material and a structural frame are required, along with the need to properly shape such members and attach them to one another. The boat design and method of manufacture according to the present invention overcomes the disadvantages of using sheet or panel materials, such as aluminum sheets, in such larger boats, and provides a cost effective, strong and aesthetically pleasing boat design. Referring now to FIG. 1, a side view of the boat 10 is shown in see-through fashion allowing a view of a boat cabin 12. The boat 10 comprises a front section, or bow 14 and a rear section, or stem 16. An engine 18 is connected to the stem 16 to propel the boat 10 through the water. FIG. 2 shows a top plan view of the boat 10. The boat 10 further comprises a first side, or port side 20 to the left of the boat 10 and a second side, or starboard side 22 to the right of the boat 10. In this view, the engine(s) are not shown, revealing the engine mount areas 60 and 64. A swim platform 24 may be provided if desired. In the description below, parts are referred to as being an inboard or outboard side. The inboard side is the side closest to the longitudinal centerline A of the boat 10. The outboard side is the side furthest from centerline A.

The boat 10 of the present invention is formed by bending large aluminum sheets into predetermined shapes, each of which will make up a substantial portion of the hull 26. The sheets are formed with curvatures along the length of hull 26 as will be described more fully hereafter, and are fixed at the seams between each section with an adjacent section. In an embodiment, the hull sections may be adhesively bonded along overlap sections between sheets after forming each to a compatible shape. The adhesive bond will create a water tight seal and preferably allow some amount of flexing to occur between sections, by providing an adhesive with an amount of resiliency. In the embodiment shown for example, a lap joint may be provided in association with an underwing or center plate 48 relative to adjacent portions 44 and 46. At the same time, the bond must withstand significant forces and vibration, which are typical in operation of the boat 10 on the water. Although the sheets are formed to match one another, the tolerances with which the sheets of hull 26 are formed relative to one another do not have to be as close as would be necessary in a welded seam, with the use of an adhesive therebetween providing some leeway in the fit of adjacent sheets to one another. Alternatively, for some of the sheets of hull 26, a welded connection may be provided relatively cost effectively, using robotic welding techniques. In such an embodiment, close tolerances between sheets are required, and allow robotic welding or other automated welding techniques to be performed. Even if welding is performed, and all of the welding is not eliminated from the construction of the boat 10, the boat is designed to take advantage of bending large sheets to desired shapes and providing other adhesively joined joints as will be described hereafter. Thus, the amount of welding required is significantly reduced, thereby reducing labor costs, time and materials needed to produce the boat 10, and eliminating much of the heat-affected zones and heat blemishes, and the potential for leaks. In addition, the use of adhesives reduces the accuracy of the fit required between the frame members and the sheet members.

Figure 3:
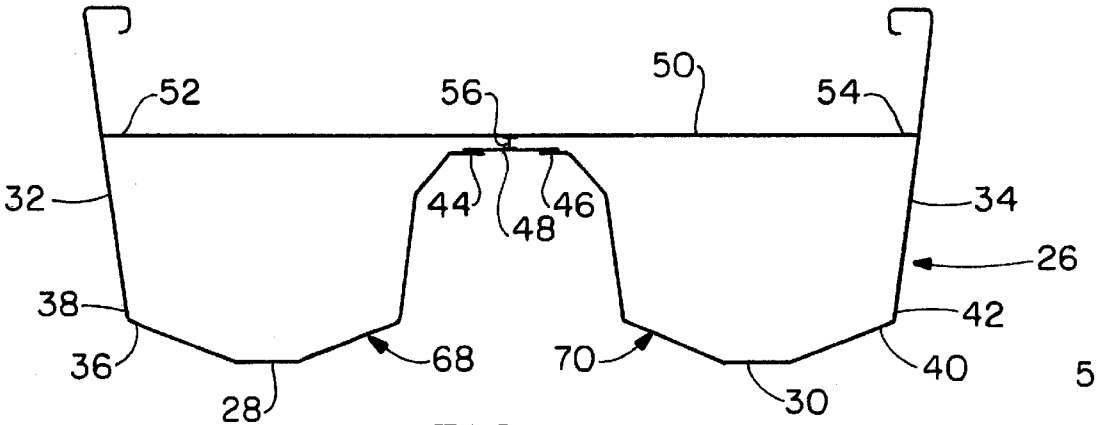
FIG. 3 is a cross-sectional view taken along line 3—3 in FIG. 1, and showing the main structural elements of the boat hull.

FIG. 3 is a cross-sectional view of the boat hull 26 taken along line 3—3 in FIG. 1. This view reveals that the boat 10 comprises a dual hull 26 design known as a catamaran. The design of the catamaran hull is more complex than a simple "V" style hull, which makes it more difficult to construct, but the dual hull provides the boat with added stability. Another benefit of the dual hull 26 is that it provides less drag at faster speeds because the space between the dual hulls 26 compresses the passing air, which tends to lift the boat. The design of the hull itself adds to the lift imparted to the boat during operation. The hull 26 comprises a first, or port bottom panel member 28, a second, or starboard bottom panel member 30, a first, or portside member 32, and a second, or starboard side member 34. An outboard portion 36 of the port bottom panel member 28 is fixably connected to a bottom portion 38 of the port side member 32. An outboard portion 40 of the starboard bottom panel member 30 is fixably connected to a bottom portion 42 of the starboard side member 34. The port bottom panel member 28 and the starboard bottom panel member 30 are each fixably attached along an inboard portion thereof 44 and 46, respectively, to a center plate member 48. Each of the panel members 28, 30, 32 and 34 may extend as one piece for the entire length of the boat 10, or additional sheets may be configured to extend the boat to the desired length. As will be described in further detail, the boat design of the present invention is scalable or can be easily modified to any length or beam dimensions. For example, if the user desires a boat which can be trailered using conventional transportation, the regulations relating to beam width and length to allow such transport may be easily designed using the basic hull design of the invention. The hull design is linearly scalable to allow flexibility to meet the needs of the user, and yet is manufactured using production boat techniques.

Each panel member 28, 30, 32 and 34 can thus be seen to comprise a significant portion of the hull 26 and bows 14 of the boat 10. The panels are formed with complex bends and curvatures to form the hull 26 as shown in the depicted embodiment. The design of each panel must therefore be precisely determined with respect to overall hull design as well as mating to an adjacent panel. The complex or differential bends and curvatures are formed in this embodiment using large press brake equipment having substantial length to handle the large sheets forming the panels. Suitable press brake equipment is manufactured by Pacific Press Technologies for example. The operation of the press brake is tailored to the sheet or panel configurations, but will impart a complex or differential lengthwise bend in each panel 28, 30, 32 and 34. To impart the complex bends and curvatures in the panels, the rams associated with the press brake equipment are independently computer controlled, and the panels manipulated in conjunction with the press operation to precisely and repeatably control the bending thereof. Computer control facilitates repeatability in the formation of panels, and the ability to repeatably form differential bends over long lengths allows the desired hull shape to be achieved cost effectively. A generally horizontal plate member, or deck 50 is attached at a first end 52 to the port side member 32 and at a second end 54 to the starboard side member 34. A support connector 56 is used to support the deck 50 above the center plate member 48.

Figure 4B:
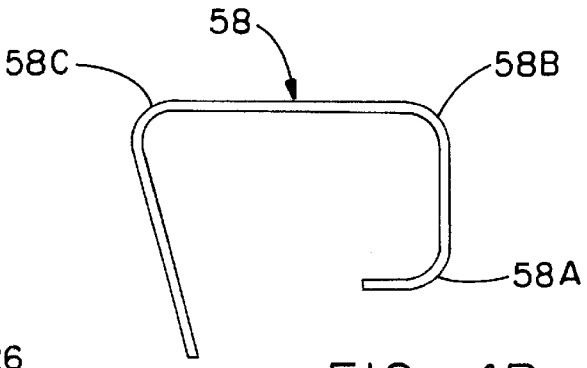
FIG. 4B is a cross-sectional view of the side member gunwale at the bow of the hull.
Figure 4C:
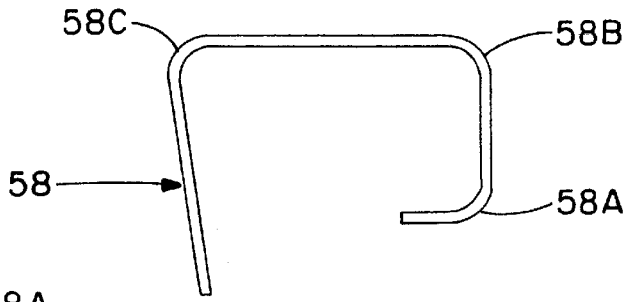
FIG. 4C is a cross-sectional view of the side member gunwale at the stem of the hull.
Figure 4A:
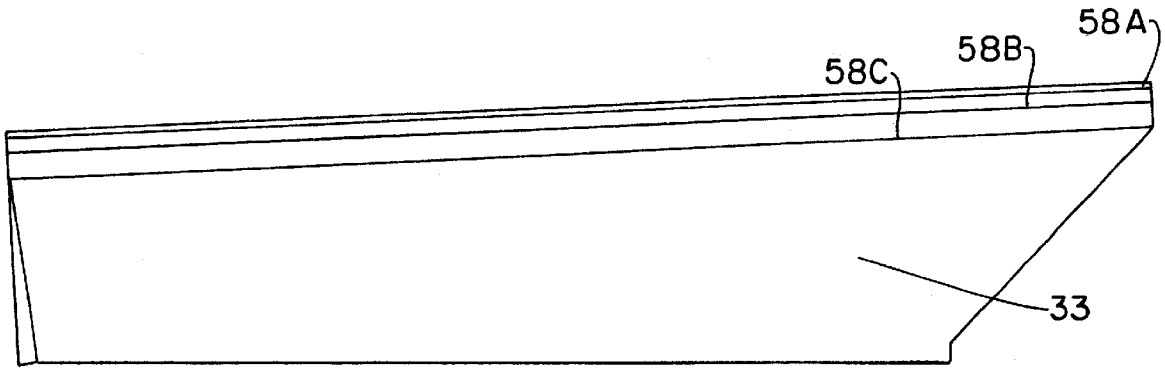
FIG. 4A is a top plan view of a blank used to form the side member of the hull.
Figure 7E:
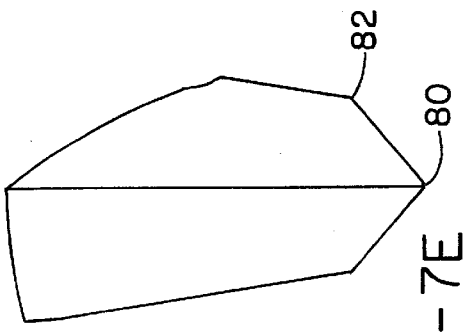
FIG. 7E is a back side elevational view of the completed bow portion of the boat of FIG. 1.
Figure 7D:
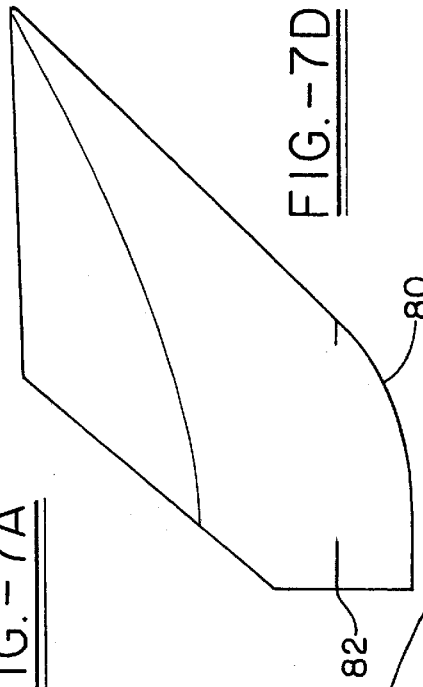
FIG. 7D is a side elevational view of the completed bow portion of the boat of FIG.
Figure 7C:
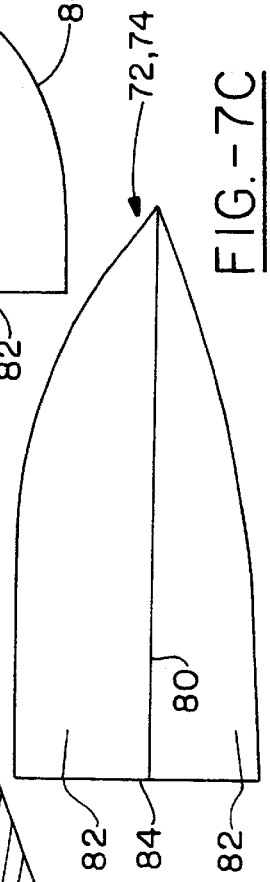
FIG. 7C is a top plan view of the completed bow portion of the boat of FIG. 1.
Figure 7A:
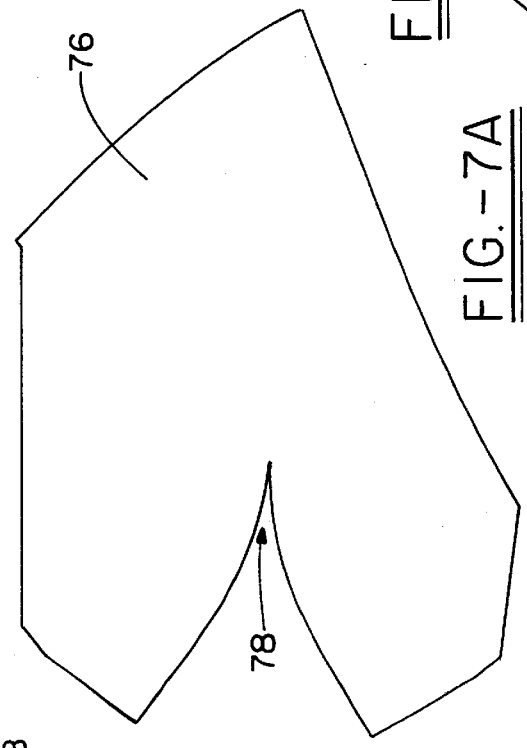
FIG. 7A is a top plan view of the blank used to form the bow portions of the boat of FIG. 1.
Figure 7B:
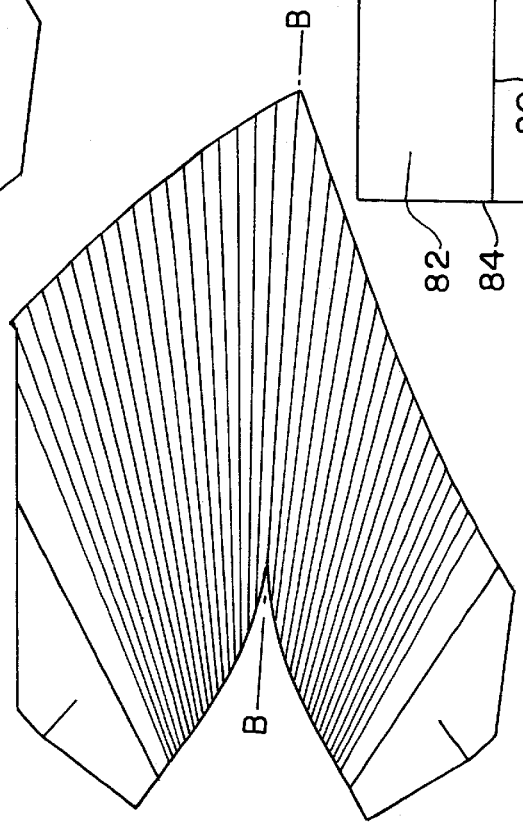
FIG. 7B is a top plan view of the blank of FIG. 7A depicting the bend lines used to form the bow portions of the boat of FIG. 1.

The side members 32, 34 are formed from a blank 33 of aluminum sheet metal of a predetermined thickness as best shown in FIG. 4A. The side members 32, 34 further comprise a uniquely formed topside portion, known as the gunwale 58 as best shown in FIGS. 4B and 4C. FIG. 4B depicts the gunwale 58 at the bow 14 of the boat 10. FIG. 4C depicts the gunwale 58 at the stem 16 of the boat 10. The gunwale 58 is a continuous and integral extension of the side members 32, 34. The gunwale 58 is formed by a series of bends, 58*a*, 58*b*, 58*c*, preferably formed by the press brake equipment previously mentioned. Each bend is formed with a predetermined radius R. The angle or radius of one or more of the bends may increase or decrease along the length of the side member 32, 34 to account for the change in the shape of the hull 26 from the bow 14 to the stem 16. The structure of the gunwale 58 adds strength to the structure of the boat 10. The gunwale of previous aluminum boat designs required that the gunwale be formed by individual strips of aluminum that were welded at angles. This method of construction required single or double continuous welds on the bottoms and sides, one weld on the inside and one weld on the outside of each joint. The amount of welding required to form the gunwale of multiple strips was therefore significant, and consumed resources of labor and time. The bending process in the present invention is performed relatively quickly without adding any material or requiring assembly labor. The bending process prevents any weak spots associated with errors or voids which may be encountered when welding. The stiffness of the gunwale 58 is enhanced by being a continuous, one piece element and by having sufficiently generous bend radii to handle the various stress loads that it will be subjected to in use.

Figure 5:
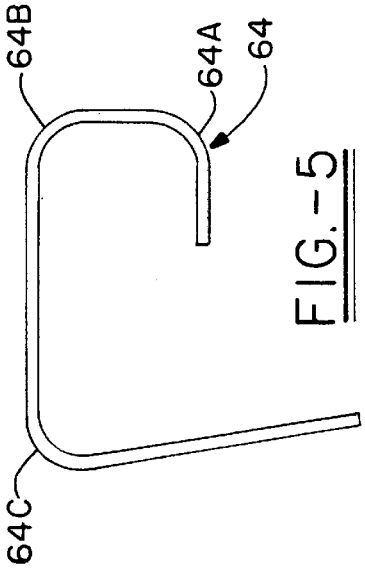
FIG. 5 is a cross-sectional view of the transom gunwale portion of the hull.
Figure 6D:
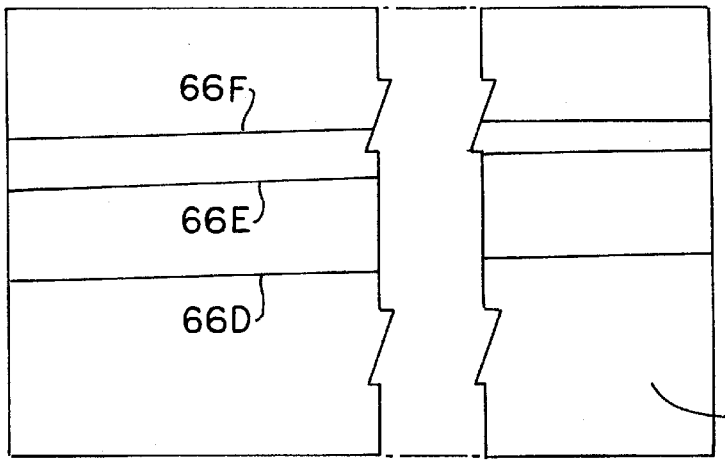
FIG. 6D shows the opposite side of the blank shown in FIG. 6C and depicts the location of the corresponding bend lines.
Figure 6C:
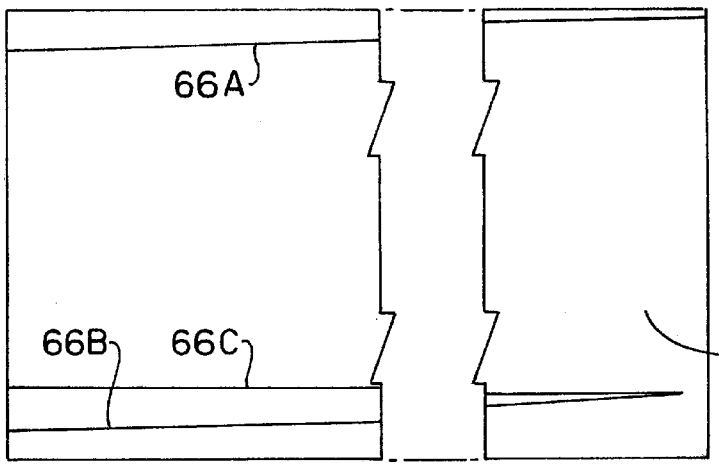
FIG. 6C shows a first side of the blank used to form the port bottom panel member as shown in FIG. 3 and depicts the location of the corresponding bend lines.
Figure 6A:
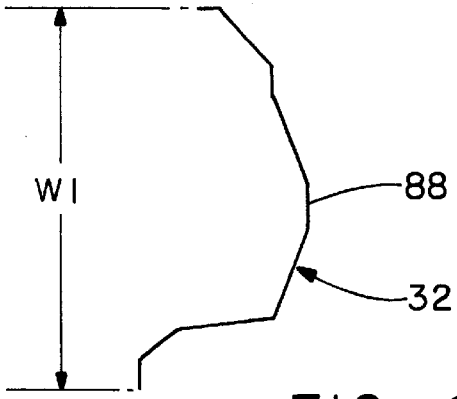
FIG. 6A is a cross-sectional view of the port bottom panel member at the stem end of the member.
Figure 6B:
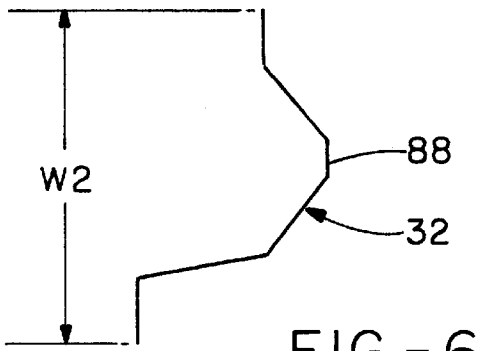
FIG. 6B is a cross-sectional view of the port bottom panel member at the bow end of the member.

The side members 32, 34, are fixably connected to the transom 60 at the stern 16 of the boat 10 as best shown in FIG. 2. The connection is typically accomplished by welding. The transom 60 may include an access door 62 hingedly connected to the transom 60. The transom 60 is formed similarly to the side members 32, 34 in that the transom 60 includes a transom gunwale 64 portion having bends 64*a*, 64*b*, 64*c*, formed in the same fashion as the gunwale 58 of the side members 32, 34 as best shown in FIG. 5. Previous aluminum boats required a welded transom formed by individual strips of aluminum that were welded at angles. As mentioned with respect to the side member gunwale 58, this method of construction required continuous welds on the inside and outside of each joint, requiring a significant amount of labor and time. The bending process used to form the transom gunwale in the present invention is performed relatively quickly without adding any material. The bending process prevents any weak spots associated with errors or voids which may be encountered when welding. The stiffness of the transom gunwale 64 is enhanced by being a continuous, one piece element and by having sufficiently generous bend radii to handle the various stress loads that it will be subjected to in use.

The formation of the bottom panel members 28, and 30, utilize bending a blank 66 of sheet metal into the desired configuration as best shown in FIGS. 6A–6D. In the preferred embodiment of the present invention, the bends are performed in a predetermined sequence on a first side 68 of the blank 66 and then in a predetermined sequence on a second side 70 of the blank 66, and possibly further bends on the first side 68 or second side 70. The order of the bends is predetermined to optimize the ease of handling the blank 66 within the press brake and to accommodate adjacent but opposing bends in the hull design. The sequencing of bends further minimizes time in turning the blank 66 over back and forth to perform opposite angled bends. The bends, 66A–66F, are typically formed at an angle such that the width W1 of the bottom panel member increases toward the stern 16 of the boat 10 in order to support the greater weight at the stern of the boat. The smaller width W2 toward the bow of the boat enables the hull to cut through the water more efficiently. The tapered, swept design is also aesthetically pleasing.

The dual hull 26 at the bow 14 of the boat 10 is constructed in a manner similar to the bottom panel members 28, 30. As discussed, each bottom panel member 28, 30 is fixably connected to a side member 32, 34, respectively. The result is that the dual hull 26 comprises a first, or port hull 68 and a second, or starboard hull 70 as shown in FIG. 3. Each of the hulls 68, 70 terminate at the stem 16 of the boat 10, and at the transom 60. Toward the bow 14 of the boat, each hull 68, 70 terminates in a pointed bow portion 72, 74, respectively. To form the hull sections 68, 70, compound curves as well as bends must be formed. Each section 72, 74 is formed from a blank 76 of sheet metal into the desired configuration as best shown in FIGS. 7A–7E. In the preferred embodiment of the present invention, the bends are performed in a predetermined sequence on first and second sides of the blank 76. The irregular shape of the blank 76 comprises generally a "V" shape, generally designated as 78, which when bent will form the desired three dimensional configuration. The order of the bends is predetermined to optimize the ease of handling the blank 76 within the press brake, generally starting from one side toward a centerline B of the blank and then on the opposite side from the bend next to the centerline to the opposite edge. The final bend along the centerline B will bring the "V" portion 78 together forming the bow bottom, or keel 80 of the bow portion 72, 74. In the embodiment shown, the curvature of the bottom panel imparted is generally in the range of 20 to 30 degrees deadrise from stem to bow, and the flat bottom sections of each are tapered toward the bow. To achieve these types of bends and curvatures, the amount of bending is varied along the length of the hull sections, with the degree of bending generally varying about 5–20 degrees from one end of the boat 10 to the other. The bow bottom 80 is fixably connected typically by welding. In the preferred embodiment, a chine 82 is formed on both sides of the bow bottom 80 along a stem side 84 of the bow portion 72, 74. The chines 82, enable the bow portion to properly mate with the bottom panel members 28, 30. The formation of the bow portion 72, 74 creates a pointed keel portion which does not meet flush with the corresponding flat bottom 88 of the bottom panel members. The pointed keel portion helps the boat 10 cut through the water. A transition piece 89, as best shown in FIG. 1 is fixably attached to the bow portion 72, 74 and the pointed keel portion to transition from a pointed profile to a flat profile.

Up to now, the exterior "skin" portions of the boat 10 have been discussed. While these portions utilize bending to eliminate much of the welding, welding may still be performed to connect these pieces, but also enables robotic welding techniques to be used, making the process more cost-effective and efficient. Moving to the interior structural members of the boat 10, attachment will be provided without welding altogether.

Figure 9:
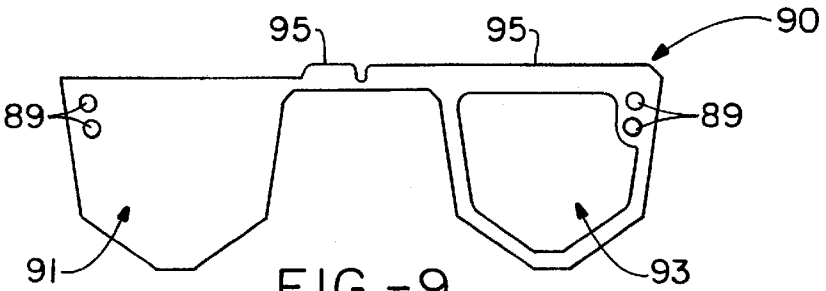
FIG. 9 is a front elevational view of a frame member having an open and a watertight side.
Figure 11:
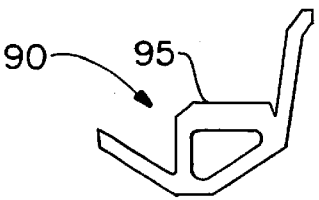
FIG. 11 is a front elevational view of a frame member comprising two bottom frame members.
Figure 8:
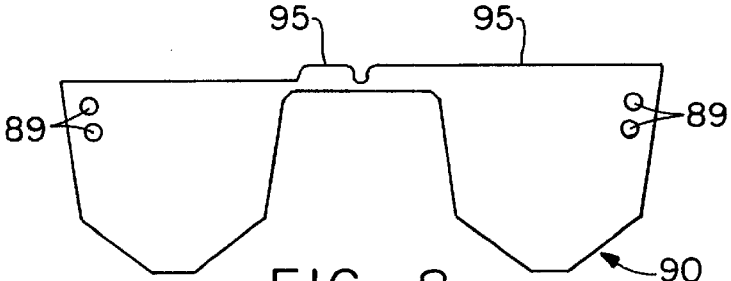
FIG. 8 is a front elevational view of a watertight frame member.
Figure 10:
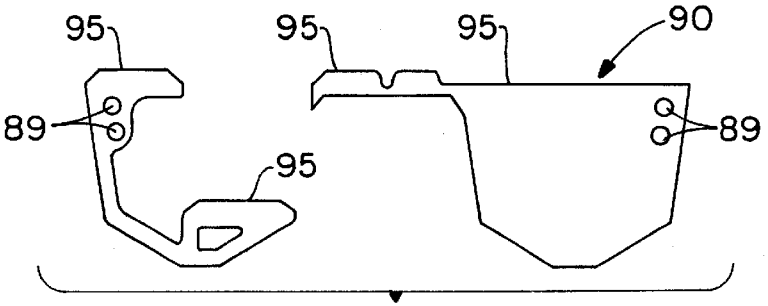
FIG. 10 is a front elevational view of a frame member comprising a separate open side and a watertight side.

The boat 10 requires internal reinforcement between the outer hull and the mechanically affixed deck 50. Such supports are generally provided by spaced frame members 90, such as crosswise ribs and/or lengthwise stringers, as best shown in FIGS. 8–11. In the embodiment shown, only ribs are required to give the structural integrity desired, but stringers may be used if desired or needed. The frame members 90 may be precisely formed by laser or water jet cutting techniques or by other suitable procedures. As the hull design and tolerances are known, the frame members 90 may be prefabricated to precise dimensions, and as will be seen, any tolerance errors are generally accounted for in the interconnection of the frame members 90 to the hull and/or deck. The frame members 90 are oriented substantially perpendicular to the centerline A of the boat 10 and placed at predetermined intervals therealong. The frame members may provide a watertight seal with the hull as shown in FIG. 8, wherein the compartments on either side are completely separated from each other except for access holes 89 typically used for electrical, water, plumbing, fuel and/or HVAC connections. The frame members 90 are adhesively secured to the hull to eliminate any welding, and to provide additional advantages. The frame members 90 also may comprise tab portions 95 which are bent perpendicular to the frame such that they can be adhesively attached to the deck 50, or other portions of the boat 10. In FIG. 9, one side of the frame has a watertight side 91, and a full frame side 93 wherein the center area of the frame is removed. This allows for access between the compartments separated by the frame members 90. Some areas of the boat 10 may require partial frame members 90 as best shown in FIGS. 10 and 11. These partial frame members 90 may be used where access to the interior of the boat 10 is needed, such as the interior cabin or a commode.

The frame members 90 are connected at their opposed edges to the internal surfaces of the hull 26 and deck 50. As the boat hull 26 is subjected to the stresses as it moves through water and waves, both tension and compression forces act on the outer hull 26 and thus act conversely on the opposed edge of the frame members 90 where they interface with the underside of the deck 50. This results in significant sheer forces within the frame member 90 and at the interfaces of the frame member 90 with the outer hull 26 or deck 50. This can cause the rupture of the interconnection of the frame member 90 to the associated hull 26 and deck 50, which would result in serious damage to the boat hull structure, and integrity of the boat. Until now, the magnitude of the sheer forces have required that the frame members 90 be welded to the hull 26 and deck 50. While savings could be obtained by stitch welding (leaving gaps between welded areas), the welding process is still costly and labor intensive. One alternative has been to use fasteners and/or integral slots within the hull which had the ability to securely clamp the frame member in place. These methods are costly and/or require extensive time or tooling.

Figure 14:
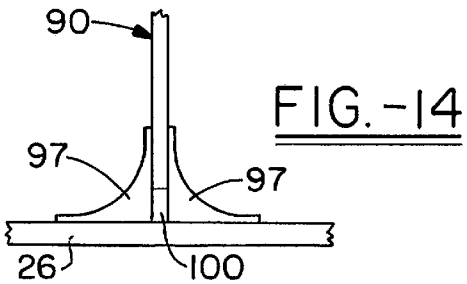
FIG. 14 is a top plan view of an adhesively connected hull and frame member using a fillet of adhesive material.
Figure 13:
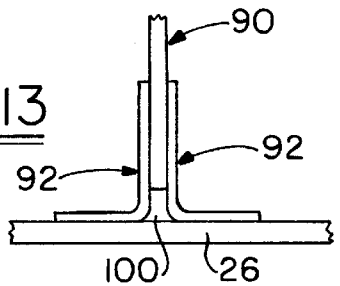
FIG. 13 is a top plan view of an adhesively connected hull and frame member using an extended bracket member and having a gap between the hull and the frame member.
Figure 12:
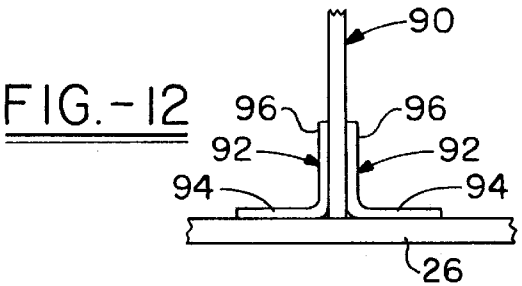
FIG. 12 is a top plan view of an adhesively connected hull and frame member using a bracket member.

The present invention instead preferably uses high strength adhesives, in liquid, caulk or tape form, to allow the frame members to be fixably connected to the hull without requiring welding or costly special connectors. In a first embodiment of the present invention, the frame members 90 are attached to the hull with the use an angled bracket 92 comprising a first side 94 adhesively connected with a suitable adhesive to the hull, deck or other portions of the boat 10 and a second side 96 adhesively connected with a suitable adhesive to the frame member 90 as best shown in FIG. 12. Typically, a bracket 92 is used on either side of the frame member 90, although one side may be used if desired. The brackets 92 can be extended to allow for a gap 100 between the frame member 90 and the hull 26 as shown in FIG. 13. The allowance for a gap 100 enables proper interconnection between the frame members 90 and other structures without requiring extremely close tolerances between the members. This in turn will save materials and labor in assembly, minimizing scrapped materials. Alternatively, the brackets 92 may be integrally formed in association with the frame member 90 by bending a portion thereof, similar to tabs 95 discussed previously. In another embodiment as shown in FIG. 14, the brackets 92 are eliminated and replaced by an adhesive fillet 97 on either side of the frame member 90. Although a gap 100 is shown, the adhesive fillets 97 can be used in the configuration not having a gap between the hull and the frame member 90. The use of adhesives replaces the costly alternatives such as welding, but also accommodates the possibility of gaps between the hull and the frame member that welding will not work on.

The adhesive used may be any one of available adhesives for use in structural applications such as, but not limited to, methacrylate glues sold under the brand names DEXTER HYSOL® H4500, 3M® Structural Bonding Tape, or 3M® VHB® Tape. The adhesive typically is used in either a liquid form, caulk or as a tape. These adhesives have superior bonding properties and are specifically formulated for bonding metal-to-metal applications for aluminum, steel, and stainless steel. These adhesives are able to withstand the stresses between the hull and the frame members, and will not degrade significantly over time due to vibration or external forces encountered in operation of the boat. The adhesive has resiliency, which will tend to absorb or dampen such vibrations or forces, while being of sufficient strength to fix the frame members into their support positions to provide the required structural integrity to the hull. The adhesives are relatively inexpensive, easily applied, and avoid the need for welding in at least portions of the boat construction, thereby avoiding the associated costs and problems. The adhesives should provide excellent shear strength as well as tensile strength to accommodate the expected loads in a marine or boating environment. For example, adequate tensile strengths might be in a range from 2,000–4500 psi.

The present invention is also directed at a computer program product for designing boat hulls. A person of ordinary skill in the art would appreciate that the invention may be embodied as a method, data processing system, or computer program product. As such, the present invention may take the form of an embodiment comprised entirely of hardware, an embodiment comprised entirely of software, or an embodiment combining software and hardware aspects. In addition, the present invention may take the form of a computer program product on a computer-readable storage medium having computer-readable program code embodied in the medium. Any suitable computer-readable medium may be utilized including hard disks, flash memory cards, CD-ROMs, optical storage devices, magnetic storage devices or the like.

The method of designing a boat hull and the computer program product of the invention is described with reference to flow charts or diagrams that illustrate methods, and systems, and the computer program product. It should be understood that each block of the various flow charts, and combination of blocks in the flow charts, can be implemented by computer program instructions. Such computer program instructions can be loaded onto a general-purpose computer, special purpose computer, or other programmable data processing device to produce a machine, such that the instructions that it executes on the computer or other programmable data processing apparatus, create means for implementing the functions specified in the flow charts. The computer program instructions can also be stored in a computer-readable memory that directs a computer or other programmable data processing device to function in a particular manner, such that the instructions stored in the computer-readable memory produce an article of manufacture including instruction means which implement the functions specified in the flow charts or diagrams. The computer program instructions may also be loaded onto a computer or other data processing apparatus to cause a series of operational steps to be performed on the computer, to produce a computer implemented process, such that the instructions which execute on the computer or other programmable apparatus provide steps for implementing the functions specified in the flow charts or diagrams.

It will also be understood that blocks of the flow charts support combinations of means for performing the specified functions, combinations of steps for performing the specified functions and program instructions means for performing the specified functions. It is also to be understood that each block of the flow charts or diagrams, and combination of blocks in the flow charts or diagrams, can be implemented by special purpose hardware-base computer systems which perform the specified functions or steps, or combinations of special purpose hardware and computer instructions.

The software program of the present invention could be written in a number of computer languages, and any suitable programming language is contemplated. It is also to be understood that various computers and/or processors may be used to carry out the present invention, including personal computers, main frame computers and mini-computers.

Figure 15:
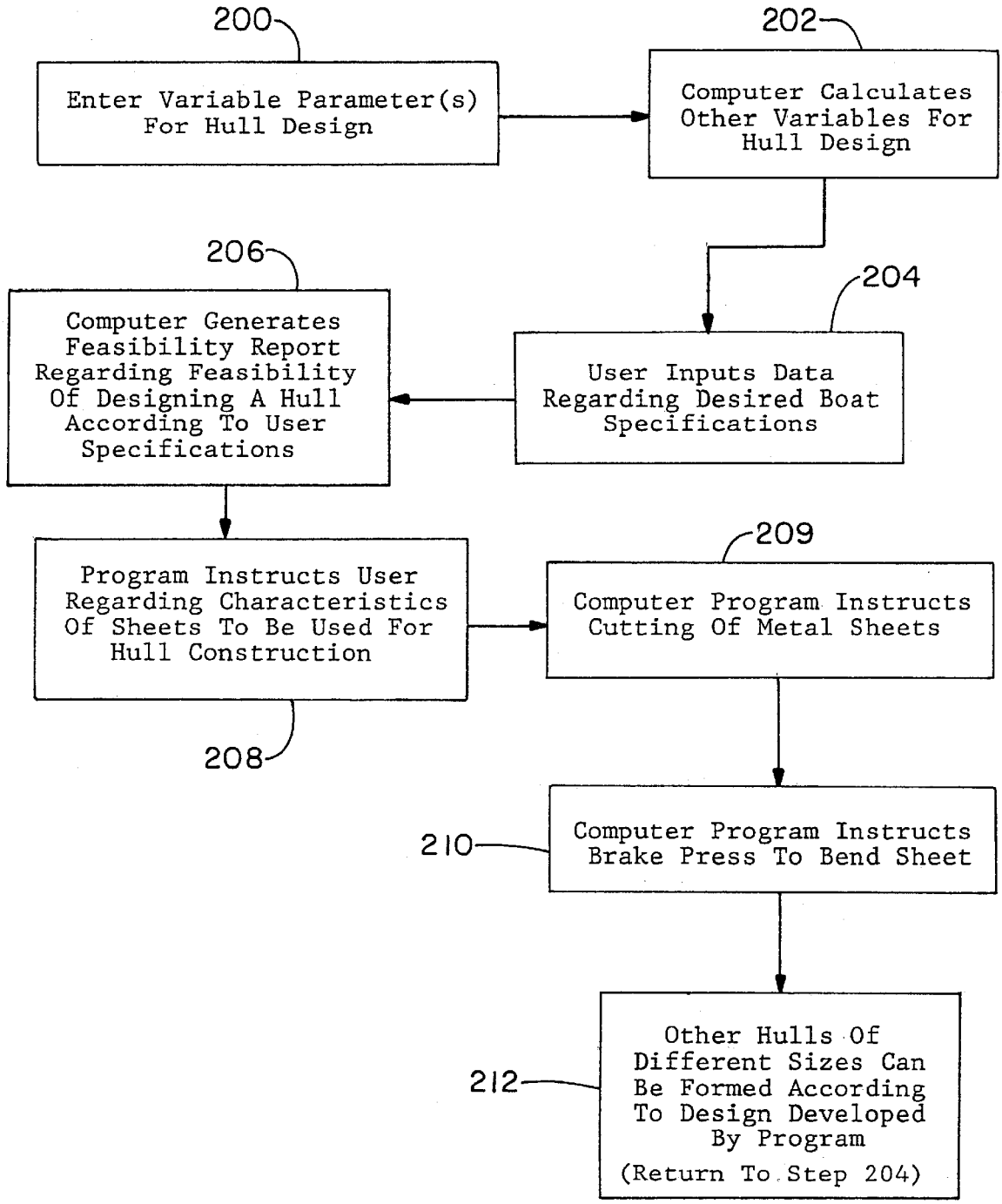
FIG. 15 is a diagram of a system and software program for designing and manufacturing a boat hull according to the invention.

As also mentioned previously, the hull design as well as supporting frame are scalable to different sizes or dimensions easily and effectively. In one embodiment of the present invention, this scalability is controlled by a computer program. As is indicated in FIG. 15, the program can create a repeatable hull design. In designing a particular boat, the consumer thus has the capability to specify certain parameters such as bull design, beam width, length or other variables for a particular purpose 200. A computer program will allow the designer, or customer themselves, to enter certain information on one or more of the design variables, and to calculate other parameters of a specific design. With any of these parameters, the other variables can be calculated to design a hull and frame construction matching the desired parameter 202. The program uses the design to determine data such as the shapes and sizes of sheets to be used in the boat construction and the order and types of bends to be imparted into the sheets for construction of the boat. The basic construction of the panels forming the hull or frame members remains consistent though the dimensional characteristics change. Thus, it would be possible to allow a user access to the software program via an internet connection or the like, to design a "custom" boat meeting the users needs or desires. In such a program, the user inputs parameters 204 which will be run through a feasibility program to determine if it is feasible to manufacture a boat to the users specifications 206. Yet, even though the design is "custom" in terms of dimensions and the like, it can be readily manufactured using production style techniques. The program further controls the formation of the hull by instructing the user as to the characteristics or the sheets to be formed into the desired hull configuration at 208. Subsequently, the computer program may generate information as to the cutting of blanks into the desired form for subsequent bending, or the program can be used to control operation of a machine or system for cutting of the blanks to the desired shape at 209. The computer program may then be used to control operation of the brake press or other bending equipment, thereby controlling the bends imparted in the formed sheets by the brake press at 210. As the design is repeatable, a user can return to step 204 and create hulls of different shapes and sizes using already existing general designs at 212. It should also be apparent that the ability to scale the boat design gives flexibility in the final design without requiring any additional tooling or the like. The same tooling and manufacturing techniques are used regardless of the particular boat design.

Although the present invention has been described above in detail, the same is by way of illustration and example only and is not to be taken as a limitation on the present invention. Further, as described above, the system and methods according the invention may be used in conjunction with other types of customized products wherein characteristics of the products are supplied by a user to generate specific information related to design criteria and/or cost and supply information. Accordingly, the scope and content of the present invention are to be defined only by the terms of the appended claims.

What is claimed is:

1. A marine vessel comprising a vessel hull formed to have:

a bow section, a stern section, a port side, a starboard side, a centerline;

a hull comprising a plurality of sheet members, each being formed into a shape to make at least a portion of said hull and being fixably attached to one another;

a plurality of frame members selectively fixed to said plurality of sheet members, wherein each of said frame members are fixed into engagement with at least one of said sheet members of said hull, and said frame members are fixed into engagement by an adhesive bond, wherein said bond provides an amount of resiliency to dampen vibrations and other forces at the location of said engagement.

2. The marine vessel of claim 1, wherein said hull comprises a port side hull and a starboard side hull, said port side hull comprising a port bottom panel member having an outboard portion and an inboard portion; a port side member having a bottom portion and a top portion, wherein said bottom portion is fixably attached to said outboard portion of said port bottom panel member; and a center plate member, wherein said inboard portion of said port bottom panel member is fixably attached to said center plate member; and said starboard side hull comprising, a starboard bottom panel member having an outboard portion and an inboard portion; a starboard side panel member having a bottom portion and a top portion, wherein said bottom portion is fixably attached to said outboard portion of said starboard bottom panel member; and said center plate member, wherein said inboard portion of said starboard bottom panel member is fixably attached to said center plate member.

3. The marine vessel as recited in claim 2, wherein said bottom portions of said port side member and said starboard side members are fixably attached to said port bottom panel member and said starboard bottom panel members by an adhesive bond.

4. The marine vessel as recited in claim 2, wherein said inboard portions of said bottom panel members are fixably attached to said center plate member by an adhesive bond.

5. The marine vessel as recited in claim 2, wherein said port bottom panel member, said starboard bottom panel member, said port side member and said starboard side panel member extend as one piece for the entire length of said vessel.

6. The marine vessel as recited in claim 2, wherein said port side member and said starboard side member are made by forming a series of bends in a sheet of material.

7. The marine vessel as recited in claim 6, wherein said side members each further comprise a gunwale made by imparting a plurality of bends in said top portion of said side members.

8. The marine vessel as recited in claim 7 wherein said bends in said gunwale have bend radii sufficient to withstand expected stress loads.

9. The marine vessel as recited in claim 1 further comprising a generally horizontal deck member fixably attached to said plurality of sheet members and at least one of said frame members.

10. The marine vessel as recited in claim 1, wherein said frame members are attached to said hull by at least one angled bracket comprising a first portion adhesively attached to said frame members and a second portion adhesively attached to said hull.

11. The marine vessel as recited in claim 10, wherein said at least one bracket are extended to form a gap between said frame member and said hull.

12. The marine vessel as recited in claim 11, wherein said gap allows for proper interconnection between said frame members and said sheet members without requiring close tolerances between said frame members and said sheet members.

13. The marine vessel as recited in claim 10, wherein said frame members are attached to said hull by two brackets, wherein one bracket is situated on each side of said frame member.

14. The marine vessel as recited in claim 1, wherein said frame members are attached to said hull by a flange mechanism directly connected to said hull.

15. The marine vessel as recited in claim 1, wherein said frame members are attached to said hull by at least one bracket.

16. The marine vessel as recited in claim 15, wherein said bracket is adhesively attached to said hull.

17. The marine vessel as recited in claim 15, wherein said bracket is an integral portion of said frame member.

18. The marine vessel as recited in claim 1, wherein an adhesive fillit placed on either side of said frame member secures said frame member in place.

19. The marine vessel as recited in claim 1, wherein said adhesive bond engagement between said frame members and said hull allows for a less close tolerance than required by welding.

20. The marine vessel as recited in claim 1, wherein said hull has a length of at least 18 feet.

21. The marine vessel as recited in claim 20, wherein said hull is formed by differential bends along an entire length of said sheet members.

22. The marine vessel as recited in claim 1, wherein said adhesive bond is formed by a material selected of liquid adhesives, caulks, or tapes.

23. The marine vessel as recited in claim 22, wherein said adhesive has a suitable shear strength and a suitable tensile strength to accommodate an expected vessel load.

24. The marine vessel as recited in claim 23, wherein said tensile strength is in a range of approximately 2,000 psi to 4,000 psi.

25. The marine vessel as recited in claim 22, wherein said adhesive is suitable for bonding metals.

26. A marine vessel comprising a hull, wherein said hull is formed from a plurality of sheet members, each of said sheet members being formed with a plurality of bends from the front to the rear thereof, at least one of said sheets being formed by imparting consecutive bends in the sheet wherein the angle of at least one of said bends varies from the front to the rear, said hull having a bottom portion.

27. The marine vessel as recited in claim 26, wherein at least one of said bends are formed at such an angle with respect to one another that a width of the bottom portion increases toward the stern of said vessel.

28. The marine vessel as recited in claim 26, wherein said plurality of sheet members are fixed into engagement with one another by an adhesive bond.

29. The marine vessel as recited in claim 26, wherein said at least one of said bends is formed using a brake press according to predetermined angles.

30. The marine vessel as recited in claim 26, wherein said plurality of bends are scalable to various vessel dimensions.

31. The marine vessel as recited in claim 30, wherein at least one of said bends are formed by a brake press controlled by a computer program to repeatably form said bends.

32. A method for forming a marine vessel hull comprising:

providing a plurality of sheet members;

forming a series of differential bends in a first side of said sheet members, said bends being formed according to a predetermined sequence;

turning said sheet member;

forming a series of differential bends in a second side of said sheet members, said bends being formed according to a predetermined sequence;

fixing said plurality of sheet members into engagement;

providing a plurality of frame members; and fixing said plurality of frame members into engagement with at least one of said sheet members by means of an adhesive bond.

33. The method of claim 32, further comprising forming a series of bends in a top portion of said sheet members to form a gunwale on each side of said hull.

34. The method of claim 32, wherein said complex bends are formed by a brake press.

35. The method of claim 32, wherein said bends are formed to have predetermined radii.

36. The method of claim 32, further comprising forming said bends in said sheet members to form at least one bottom surface wherein the width of said bottom increases along the length of said hull.

37. The method of claim 32, further comprising:

forming pointed ends at the bow end of said hull by forming a series of bends in a sheet member metal having "V" shape cut therein and having a centerline;

forming said series of bends in said sheet member having a "V" shape according to a predetermined sequence to form a keel having a first side and a second side;

forming a chine on both sides of said keel, said chines allowing said keel to fit said bottom of said hull;

mating said chines to said bottom; and bonding said chines to said bottom with adhesive.

38. The method of claim 37, wherein said bends are made first from a first outer edge said sheet having a "V" shape cut therein towards said centerline of said sheet and next from a second outer edge of said sheet towards said centerline of said sheet.

39. The method of claim 32, further comprising determining said predetermined sequence of bends by a computer program.

40. A method for forming a marine vessel hull comprising:

providing a computer program which has the capability to generate a hull design based on at least one specified parameter;

inputting said at least one parameter into said computer program;

generating via said computer program a scalable hull design based on said at least one parameter.

41. The method of claim 40, further comprising:

inputting at least one dimension for said hull to be formed;

generating a data report based on said at least one dimension and said scalable hull design; said report including a shape of a material sheet to be used for said hull, a size of said material sheet, and bends to be imparted in said sheet to form said hull.

42. The method of claim 41, further comprising:

accessing said computer program via Internet web site to input said at least one dimension for said hull to be formed.

* * * * *